United States Patent [19]

Prince, Jr.

[11] Patent Number: 4,827,576

[45] Date of Patent: May 9, 1989

[54] BUTTONSLOT NECKTIE FASTENER

[76] Inventor: Gorman W. Prince, Jr., 11,111 W. Bellfort, Houston, Tex. 77099

[21] Appl. No.: 111,594

[22] Filed: Oct. 23, 1987

[51] Int. Cl.[4] ..... A41D 25/04

[52] U.S. Cl. ..... 24/49 CF; 24/49 TS; 24/56; 2/145

[58] Field of Search ..... 24/49 R, 49 CF, 49 M, 24/49 K, 49 TS, 49 C, 49 S, 49 CD, 54, 56, 57, 50, 58, 60, 304, 306, 546, 563, DIG. 28; 2/145

[56] References Cited

U.S. PATENT DOCUMENTS

| | | | |
|---|---|---|---|
| 394,746 | 12/1888 | Williamson | 24/49 TS X |
| 1,291,090 | 1/1919 | Nuzum | 2/145 |
| 1,434,797 | 11/1922 | Shannon | 2/11 |
| 1,751,963 | 3/1930 | Weinschreider | 2/145 |
| 1,798,432 | 3/1931 | Ratajack . | |
| 2,029,597 | 2/1936 | Thomas | 24/49 |
| 2,389,784 | 11/1945 | Kennedy | 24/49 TS |
| 2,585,690 | 2/1952 | Schafer | 24/58 |
| 2,628,398 | 2/1953 | Laverty et al. | 24/563 X |
| 2,671,900 | 3/1954 | Schreter | 2/145 |
| 2,738,513 | 3/1956 | Carty | 2/145 |
| 2,746,055 | 0/0000 | Gleason | 2/145 |
| 2,813,273 | 0/0000 | Schreter | 2/145 |
| 2,990,551 | 7/1961 | Schreter et al. | 24/49 TS X |
| 3,128,471 | 4/1964 | Bertrand | 2/145 |
| 3,151,371 | 10/1964 | Ellestad | 24/55 |
| 3,360,800 | 1/1968 | Less | 24/49 TS X |
| 3,467,993 | 9/1969 | Smith | 24/50 |
| 3,474,503 | 10/1969 | Less | 24/56 |
| 3,529,327 | 9/1970 | Missakian | 24/56 |
| 3,793,681 | 2/1974 | Casstevens, Jr. | 24/49 CF X |
| 3,950,823 | 4/1976 | Schreter | 24/49 |
| 3,968,544 | 7/1976 | Sinclair | 24/49 CF |
| 4,554,710 | 11/1985 | Grant | 24/49 CF |

FOREIGN PATENT DOCUMENTS

| | | | |
|---|---|---|---|
| 217723 | 10/1958 | Australia | 24/49 M |
| 620458 | 4/1927 | France | 24/49 CF |

*Primary Examiner*—Kenneth J. Dorner
*Assistant Examiner*—Laurie K. Cranmer

[57] ABSTRACT

A buttonslot necktie fastener which is permanently fastened to the back side of a necktie loop-label orientated at parallel to said necktie allowing the narrow section of said necktie to be captured in between the wide section of said necktie and the loop-label with permanently affixed buttonslot necktie fastener.

8 Claims, 1 Drawing Sheet

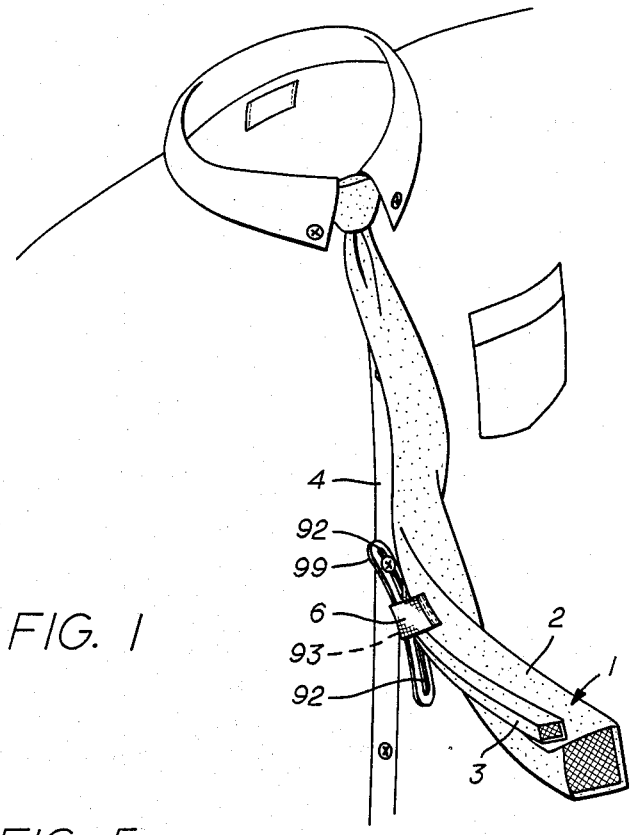
FIG. 1
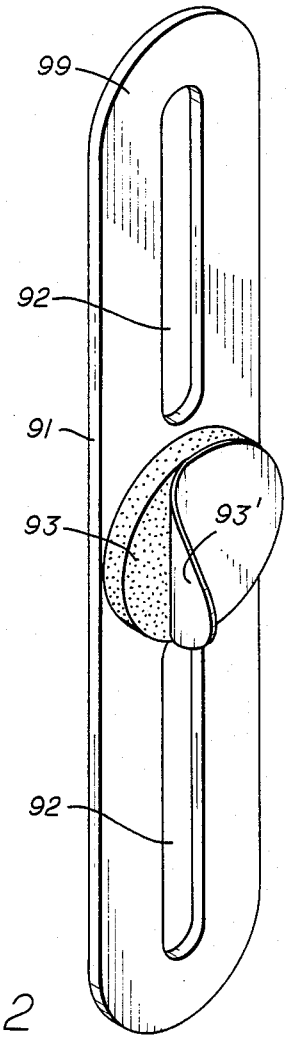
FIG. 2
FIG. 5
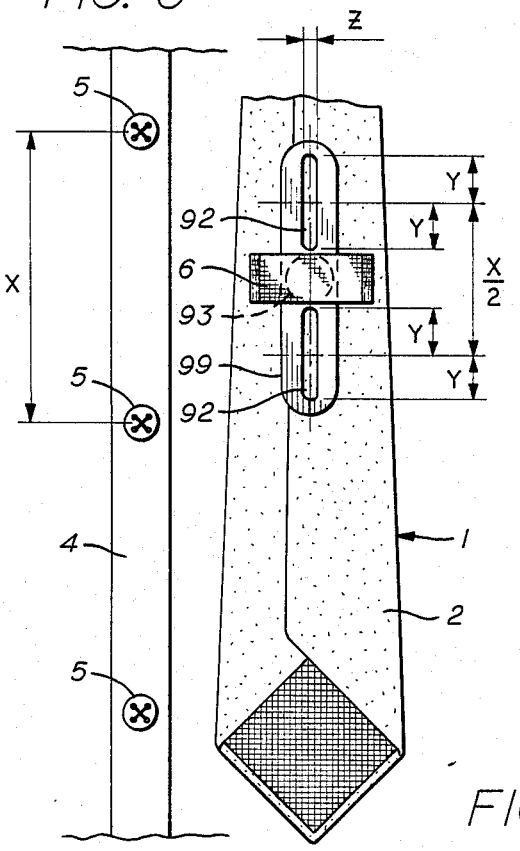
FIG. 3
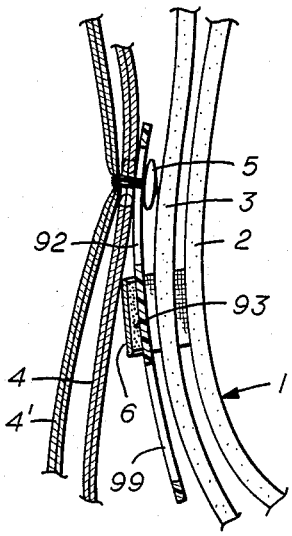
FIG. 4

BUTTONSLOT NECKTIE FASTENER

BACKGROUND OF THE INVENTION

Our society suggests that proper attire for a man includes a dress shirt and a necktie. For some time now, the trend in neckties have been towards a clean appearance, that is, one without a visible fastener. Unfortunately, a lot of necktie wearers are forced to use paper clips, safety pins and the like, in order to keep their neckties in place while at the same time, maintaining a clean apearance. Without benefit of a necktie restraining fastener, the necktie is free to waver in the wind, in food and generally become disassociated from its optimium position of contiguous alignment with the man's physique. It would be of further benefit, if said necktie restraining fastener could become a permanent part of the necktie thereby eliminating the need to take the time to retrieve a separate fastener.

Devices such as tie tacks and other restraining apparatus have been developed to maintain the said contiguous alignment, but there are numerous differences in the prior art and the invention at hand. The invention in hand is a non-destructive necktie restraining fastener which attaches to the back of a four-in-hand or "clip-on" necktie loop-label or to the back of the wide section of a necktie. After attachment, slots allow communication with buttons of a shirt. The slots are positioned in such a way as to insure contact with at least one button. Once the communication is complete, the buttonslot necktie fastener permits unrestrained tie movement in parallel relation to the shirt.

During the course of writing this patent, several prior patents were reviewed and have been concluded to be not identical and nonobvious in connection with the invention at hand.

In *Neck Scarf,* Dewey, U.S. Pat. No. 1,048,393, a device is disclosed which has a band or strip comprising flaps having flexible strips with button holes. The difference between this patent and the invention in hand is that the flaps are not attached to the loop-label and the device is not semi-rigid. Another difference is that the invention in hand uses unique slots rather than buttonholes. Finally, the invention in hand, lends itself to being applied to an existing necktie in an after market situation, whereas in *Neck Scarf,* since this invention has to do with the necktie construction, it is not possible. Similar patents include a *TIE,* Weinschreider, U.S. Pat. No. 1,751,963, *Neck Tie Holding Means,* Miller, U.S. Pat. No. 2,749,553. In *Neck Tie,* Nuzum, U.S. Pat. No. 1,291,090, a necktie was disclosed having a cloth bar with a cloth strip having a button hole in one end for receiving the button on the shirt. This devise does not permit the unrestrained movement of a necktie parallel to a shirt by use of unique slots and semi-rigid material, such as the invention in hand. The invention at hand is able to be attached to an existing necktie loop-labels, whereas these devices cannot be so attached.

In *Neck Tie Fastener,* Shannon, U.S. Pat. No. 1,434,797, a rectangular piece of fabric is stitched onto the back of the wide section of a necktie having a plurality of button holes therein. This device is fundamentally different in that it uses a plurality of button holes where the invention in hand utilizes unique vertical slots to allow said shirt movement. The invention in hand can be attached to an existing necktie loop-label or loop whereas this device can not be so attached. The invention in hand uses a semi-rigid material whereas this device uses fabric.

In *Tie Holder,* Thomas, U.S. Pat. No. 2,029,597 a fabric tab is positioned on a resilient member which allows the insertion of a necktie therein. The fabric tab has a button hole vertically orientated which communicates with a shirt button. The fundamental difference between this device and the invention in hand is that the device is visible on the front of the necktie wherein the invention in hand is not visible. Also, the necktie holder has a buttonhole and not slots and is not attached to the loop-label.

OBJECTS OF THE INVENTION

This invention relates to a device which functions to maintain the parallel integrity of a necktie in relation to a shirt being so worn.

The object of the invention is to provide a fastener on a necktie that is connectable to a button or buttons of a shirt.

Another object of the invention is to provide such a buttonslot necktie fastener which will be neat in appearance, convenient in use being simple in structure and capable of being mass manufactured economically from inexpensive material.

A further object of the invention is to provide a buttonslot necktie fastener which is not visible during its use; that is, when it is fastened permanently to a loop-label on the backside of the necktie and fastened to the buttons protruding from the shirt.

Further another object of the invention is to provide such a fastener which does not penetrate the necktie.

Another object of the invention is to permit unrestrained parallel movement to a shirt after the buttonslot necktie fastener has been attached to the necktie.

A further object of this invention is to provide a necktie fastener which can be easily and permanently attached to an existing necktie by an individual not skilled in the art, thereby making the necktie self fastening.

These and other objects and advantages result in certain novel features of construction, arrangement and combination of parts as will be more fully described hereinafter and pointed out in the appended claims.

BRIEF DESCRIPTION OF THE FIGURES

FIG. 1 is a perspective view of a shirt 4, necktie 1 and the buttonslot necktie fastener 99 being so attached to the necktie loop-label 6 and button 5 of the shirt 4. The figure illustrates a wide section 2 and a narrow section 3 of the necktie 1.

FIG. 2 is a view of the buttonslot necktie fastener 99 illustrating the adhesive means 93 and slots 92 which communicate with the wide section 2 vis-a-vis the buttons 5.

FIG. 3 is a rear plan view of the wide section 2 of a necktie 1 illustrating the parallel attachment of said buttonslot necktie fastener 99 and the spacing of the slots 92, "X/2". The length of each slot 92 is "2Y".

FIG. 4 is a side view illustrating the assembly of said necktie 1 and the assembly of said buttonslot necktie fastener 99 to said shirt 4 utilizing a button 5.

FIG. 5 is a plan view of a shirt 4 illustrating the pitch X of said buttons 5.

DETAILED DESCRIPTION OF THE FIGURES

FIG. 1 is a perspective view of the buttonslot necktie fastener 99 fastened to a loop-label 6 which is located on the back side of the wide section 2 of necktie 1. A shirt 4 has a plurality of buttons 5 which communicate with the said buttonslot necktie fastener 99 through either of its slots 92. The buttonslot necktie fastener 99 is fastened to the said loop-label 6 utilizing adhesive means 93. A pealable and removable adhesive shield 93' isolates said adhesive means 93 which in this embodiment is a two sided foam tape prior to its use.

FIG. 2 is a perspective view of the said buttonslot necktie fastener 99. The buttonslot necktie fastener 99 is manufacturable from narrow and thin pliable materials. buttonslot necktie fastener 99 is of sufficient length to be aligned with a button 5 of said shirt 4. The alignment may be above or below the loop-label 6 of said necktie 1. Centrally located between the slots 92 is adhesive means 93. The adhesive means 93 is permanently affixed to the member 91 having adhesive shield 93' which is a protective covering which ultimately is removed during the placement of the buttonslot necktie fastener 99 on the inside of said loop-label 6.

FIG. 3 illustrates the assembly of the said buttonslot necktie fastener 99 onto and within the space between said loop-label 6 and said necktie 1. As shown the adhesive means 93 affixes the buttonslot necktie fastener 99 to the inside of the said loop-label 6 orientating the said buttonslot necktie fastener 99 parallel to the necktie. FIG. 4 is a side view illustrating the assembly of the buttonslot necktie fastener 99, necktie 1 and shirt 4. The adhesive means 93 centrally attached to the buttonslot necktie fastener 99 communicates with the backside of the label 6 the button 5 as shown and holds the layers of shirt together said button 5 being positioned within a slot 92 which has a width "Z" which is so wide as to allow the thickest of buttons to enter it without contact with the edge of slot 92. The narrow section of the necktie 3 is illustrated in between the wide section of the necktie 2 and the buttonslot necktie fastener 99 within said loop-label 6.

FIG. 5 illustrates a pattern of the buttons 5 wherein the pitch between each said button 5 is "X".

The pitch between the two slots 92 is of such value as to be equal to one half the distance between the buttons as patterned on the shirt 4.

SUMMARY OF THE INVENTION

The buttonslot necktie fastener 99 is a narrow elongated member stamped from pliable material such as polyethylene. It has several axial orientated slots in proximity to each end of the flat member 91. Centrally located there is adhesive means 93 which is permanently affixed to the member 91. It has a removable shield 93' which isolates the adhesive until its application by removing said shield 93'. After removal the buttonslot necktie fastener 99 is pressed against the back side of the loop-label 6, the buttonslot necktie fastener 99 now being permanently axially aligned with the necktie 1. The narrow section 3 is placed within the loop created by the loop-label 6 leaving at least one slot 92 in potential communication with a button 5.

What I claim as being new and novel is:

1. A fastener which is suitable for attachment to a necktie for securing the necktie in place on the shirt of a person wearing a necktie where said shirt has a plurality of buttons spaced at a standard and uniform distance along its front, said fastener comprising;

a resilient, relatively thin base member having a length substantially greater than its width, said base member having a greater relative stiffness than said tie;

an adhesive means mounted substantially centrally of the base member such as to create two free ends, and on one side of said member for adhesively securing the member to the necktie;

said base member having longitudinal slots extending lengthwise thereof on opposed sides of the adhesive means for receiving a button on said shirt to thereby secure the fastener and the necktie in a desired position, said longitudinal slots allowing substantial longitudinal movement of said base member relative to said shirt.

2. The fastener as defined in claim 1, wherein said base member is made of polyethylene or other polymeric material.

3. The fastener as defined in claim 1, wherein said adhesive means is a two sided foam tape.

4. The fastener as defined in claim 1, wherein each longitudinal slot has a length of at least ¼ the distance between standard shirt buttons and a width approximately equal to the thickness of a standard shirt button.

5. The slots as defined in claim 4, where said slots have a distance between their centers equal to ½ of the distance between standard shirt buttons.

6. The fastener as described in claim 1, which can be attached to the backside of the wide end of the necktie and the narrow end tacked in the shirt when the necktie does not have a loop or loop-label.

7. The fastener as described in claim 1, which can be die cut in one-step, with no other steps needed except for attachment of the adhesive means.

8. The fastener as defined in claim 1, wherein the adhesive means is suited for securing the fastener to a loop on the back side of a tie.

* * * * *